US005952110A

United States Patent [19]

Schell et al.

[11] Patent Number: 5,952,110

[45] Date of Patent: Sep. 14, 1999

[54] ABRASIVE CERAMIC MATRIX TURBINE BLADE TIP AND METHOD FOR FORMING

[75] Inventors: Jerry D. Schell, Evendale; Howard J. Farr, Blue Ash, both of Ohio

[73] Assignee: General Electric Company, Cincinnati, Ohio

[21] Appl. No.: 08/772,965

[22] Filed: Dec. 24, 1996

[51] Int. Cl.[6] ..... B21D 39/00

[52] U.S. Cl. ..... 428/621; 428/622; 428/623; 428/632; 428/633; 428/678; 428/680; 428/935; 428/937; 427/203; 427/205; 427/427; 427/453; 205/109

[58] Field of Search ..... 51/307, 309; 428/560, 428/556, 558, 615, 678, 680, 688, 935, 937, 622, 623, 632, 621, 633; 427/427, 453, 203, 205; 205/110, 109

[56] References Cited

U.S. PATENT DOCUMENTS

| | | | |
|---|---|---|---|
| 4,169,020 | 9/1979 | Stalker et al. | 204/16 |
| 4,789,441 | 12/1988 | Foster et al. | 204/37.1 |
| 4,802,828 | 2/1989 | Rutz et al. | 416/241 B |
| 5,015,502 | 5/1991 | Strangman et al. | 427/248.1 |
| 5,076,897 | 12/1991 | Wride et al. | 205/110 |
| 5,316,866 | 5/1994 | Goldman et al. | 428/621 |
| 5,653,579 | 8/1997 | Glezer et al. | 415/173.1 |
| 5,683,825 | 11/1997 | Bruce et al. | 428/698 |

*Primary Examiner*—Paul Thibodeau
*Assistant Examiner*—Holly C. Rickman
*Attorney, Agent, or Firm*—Andrew C. Hess; David L. Narciso

[57] ABSTRACT

An abrasive coating suitable for forming an abrasive blade tip of a gas turbine engine. The coating is characterized as being capable of abrading a ceramic shroud at elevated temperatures during the in-service operation of the engine, and being resistant to oxidation and hot corrosion within the engine environment. The abrasive coating includes an MCrAl alloy layer, a ceramic layer overlying the alloy layer so as to form an outer surface of the abrasive coating, and abrasive particles dispersed between the alloy layer and the ceramic layer so that at least some of the abrasive particles are partially embedded in the alloy layer and also partially embedded in the ceramic layer. In addition, at least some of the abrasive particles project above the outer surface of the abrasive coating formed by the ceramic layer.

19 Claims, 1 Drawing Sheet

ABRASIVE CERAMIC MATRIX TURBINE BLADE TIP AND METHOD FOR FORMING

The present invention relates to turbine blades. More particularly, this invention relates to an abrasive blade tip coating for turbine blades of a gas turbine engine, in which the coating includes an alloy layer that is resistant to hot corrosion and oxidation, a ceramic layer overlying the alloy layer, and abrasive particles that are each partially embedded in both the alloy and ceramic layers, and project from the ceramic layer to form an abrasive surface.

BACKGROUND OF THE INVENTION

The operation of axial flow gas turbine engines involves the delivery of compressed air to the combustion section of the engine where fuel is added to the air and ignited, and thereafter delivered to the turbine section of the engine where a portion of the energy generated by the combustion process is extracted by a turbine to drive the engine compressor. Accordingly, the efficiency of gas turbine engines is dependent in part on the ability to minimize leakage of compressed air between the turbine blades and a shroud that circumscribes the turbine.

To minimize the radial gap between the turbine blade tips and the shroud, turbine blades often undergo a final grind such that the turbine assembly closely matches its shroud diameter. As a result, some degree of rubbing with the shroud typically occurs during the initial operation of the engine due to manufacturing tolerances, differing rates of thermal expansion and dynamic effects. However, rubbing contact between the blade tips and shroud tends to spall the tips, which further increases the radial blade-shroud gap and shortens the useful life of the blade. As such, it is well known in the art to form a dynamic seal between the rotor blades and the shroud by forming an abrasive ("squealer") tip on the end of the turbine blades. Prior art abrasive tips have often entailed abrasive particles dispersed in an oxidation-resistant metallic matrix, as evidenced by U.S. Pat. No. 4,169,020 to Stalker et al., assigned to the assignee of this invention. During initial operation of the turbine, the abrasive tip abrades a groove in the shroud as a result of numerous "rub encounters" between the abrasive tip and the shroud. The groove, in cooperation with the blade tips as they partially extend into the groove, forms a virtual seal between the blade tips and the shroud. The seal reduces the amount of gases that can bypass the blades, and thereby improves the efficiency of the turbine engine.

Much emphasis has been placed on developing suitable combinations of metal matrix materials with abrasive particles, as well as methods for their manufacture. Generally, material combinations have been developed to be capable of abrading metallic shroud materials, such as Bradelloy, CoNiCrAlY and iron, nickel and cobalt-base superalloys, while exhibiting minimal reactivity between the abrasive and matrix materials. In addition, suitable metal matrix materials must exhibit acceptable environmental resistance (i.e., oxidation and hot corrosion resistance) to the operating environment of a gas turbine engine. With these requirements, the prior art has proposed various metal matrix materials, including nickel-base alloys, and various abrasive materials, including nitrides such as BORAZON (cubic boron nitride), carbides, and oxides such as aluminum oxide (alumina). Though widely used, BORAZON will not survive the typical turbine engine environment. As such, blade tips formed with this material are no longer abrasive after an initial engine "green run." Abrasive materials capable of surviving in the hostile environment of a gas turbine engine are often preferred to protect the blade tips during rub encounters that occur during in-service operation of the engine.

As engine performance has pushed gas path temperatures up, the use of shrouds formed of ceramic materials has increased. However, ceramic shrouds are more difficult to abrade than prior art metallic shrouds. One solution has been to reduce the shroud density by increasing the porosity of the ceramic material, though a drawback is that such shrouds are more susceptible to gas stream erosion or gas-borne particulate erosion than are shrouds formed from denser ceramic materials. Another difficulty encountered with the use of ceramic shrouds is that the ceramic shroud material is more abrasive to the metal matrix material of the abrasive blade tip, causing higher wear rates for the abrasive particles. In addition, ceramic shrouds tend to sustain significantly higher surface temperatures, leading to melting or substantial strength loss of the metal matrix material. In response to these issues, the prior art has proposed the deposition of abrasive particles in the form of a blade tip coating, such as by plasma spraying. However, ceramic coatings of this type have been found to be prone to spallation.

Thus, it would be desirable to provide an abrasive blade tip material that is compatible with a ceramic shroud, and that can survive numerous rub encounters with a ceramic shroud, while also exhibiting suitable environmental and spall resistance within the hostile operating environment of a gas turbine engine.

SUMMARY OF THE INVENTION

It is an object of this invention to provide an abrasive coating capable of abrading a ceramic material.

It is another object of this invention that the abrasive coating is suitable as a blade tip material for a turbine blade of a gas turbine engine.

It is yet another object of this invention that abrasive coating is capable of surviving numerous rub encounters with a ceramic shroud during in-service operation of the engine.

It is still another object of this invention that the abrasive coating employs an alloy layer that is environmentally resistant to the hostile operating environment of a gas turbine engine.

It is a further object of this invention that the abrasive coating can be readily and reliably formed on the tip of a turbine blade.

In accordance with a preferred embodiment of this invention, these and other objects and advantages are accomplished as follows.

The present invention provides an abrasive coating that is suitable for forming an abrasive blade tip of a gas turbine engine. The coating is characterized as being capable of abrading a ceramic shroud at elevated temperatures during the in-service operation of the engine, and being resistant to oxidation and hot corrosion within the engine environment. The abrasive coating includes a layer of a strengthened MCrAl alloy, such as an NiCrCoAl alloy layer, a ceramic layer overlying the alloy layer so as to form an outer surface of the abrasive coating, and abrasive particles dispersed between the alloy layer and the ceramic layer so that at least some of the abrasive particles are partially embedded in the alloy layer and also partially embedded in the ceramic layer. In addition, at least some of the abrasive particles project above the outer surface of the abrasive coating formed by the ceramic layer. Preferred MCrAl alloys promote the environmental resistance and strength of the abrasive coating, while preferred ceramic materials include yttria-stabilized zirconia (YSZ). Finally, preferred abrasive particles are microcrystalline oxide particles, and particularly sol-gel alumina.

A preferred method by which the abrasive coating of this invention is formed involves depositing the MCrAl alloy on the substrate to form an initial alloy layer. Thereafter, deposition of the MCrAl alloy is continued in the presence of the abrasive particles, such that a dispersion of the abrasive particles is incorporated into the MCrAl alloy layer. Deposition of the MCrAl alloy is stopped such that the abrasive particles are only partially embedded in the MCrAl alloy layer. The ceramic layer is then deposited on the MCrAl alloy layer so as to form an outer surface of the abrasive coating. In so doing, the abrasive particles are also partially embedded in the ceramic layer. Deposition of the ceramic layer is also limited to ensure that at least some of the abrasive particles project above the surface of the ceramic layer.

According to this invention, partially embedding the abrasive particles in both the alloy and ceramic layers yields an abrasive coating that is suitable as an abrasive blade tip material for gas turbine blades, particularly where the blades are surrounded by a ceramic shroud. In particular, the coating is capable of surviving numerous rub encounters with ceramic shroud materials in the hostile environment typical of a gas turbine engine. The manner in which the abrasive particles are embedded in two different materials, each having different mechanical, physical and environmental properties, has been found to promote the service life of the particles and the coating. The environmentally-resistant MCrAl alloy layer protects the underlying substrate from the hostile engine environment, while the abrasive particles and ceramic layer protect the substrate and alloy layer from contact with the ceramic shroud. The preferred materials for the constituents of the coating further promote these characteristics.

Other objects and advantages of this invention will be better appreciated from the following detailed description.

BRIEF DESCRIPTION OF THE DRAWINGS

The present invention will now be described, by way of example, with reference to the accompanying drawings, in which.

DERAILED DESCRIPTION OF THE INVENTION

Figure 1:
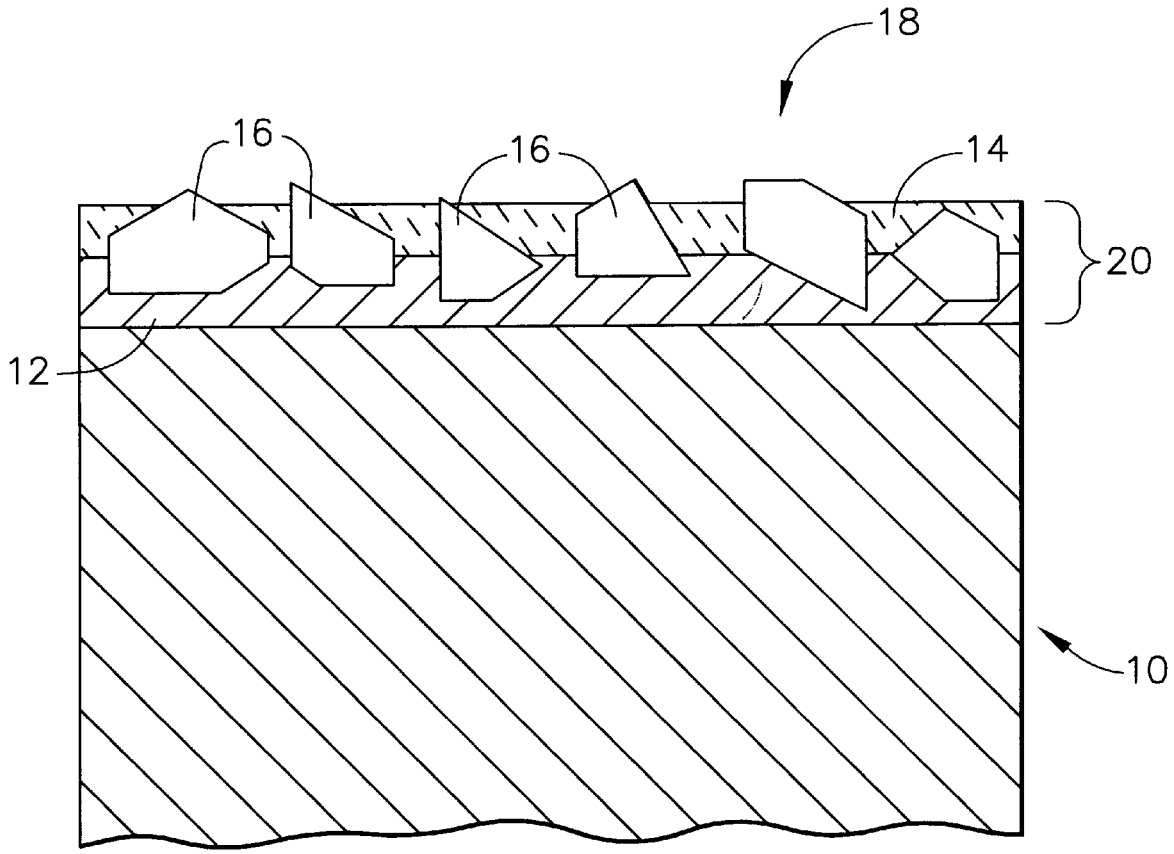
FIG. 1 is a cross-sectional view of a high pressure turbine blade tip on which is formed a ceramic matrix abrasive tip in accordance with this invention.

The present invention provides an improved blade tip for turbine blades used in gas turbine engines, and particularly turbine blades used in the high pressure turbine section of an axial flow gas turbine engine. A cross-section of a blade tip 18 of a turbine blade 10 is represented by FIG. 1, and is shown to have an abrasive blade tip coating 20 formed in accordance with a preferred embodiment of this invention. Turbine blades of the type represented in FIG. 1 are typically formed from a suitable high temperature material, such as an appropriate iron, nickel or cobalt-base superalloy, and may be cast as single crystal or directionally solidified casting to promote the high temperature properties of the blade.

In accordance with this invention, the abrasive blade tip coating 20 exhibits the required mechanical and environmental properties for survival in the more hostile environments endured by gas turbine engines. Importantly, the coating 20 also exhibits the necessary properties to survive numerous rub encounters with a ceramic shroud (not shown) during an initial "green run" and the in-service operation of a gas turbine engine. As shown in FIG. 1, the coating 20 incorporates an environmentally-resistant alloy layer 12 that is protected by a thermally-insulating ceramic layer 14, both of which serve to anchor abrasive particles 16 to the blade tip 18. The thicknesses of the alloy and ceramic layers 12 and 14 are dictated in part by the requirement that substantially all of the abrasive particles 16 are individually anchored to the blade tip 18 with each of these layers 12 and 14, and that the particles 16 project above the surface of the ceramic layer 14, as shown in FIG. 1. As such, the coating 20 generally contains a single layer of particles 16, and the size of the particles 16 determines how thick the alloy and ceramic layers 12 and 14 will be. A preferred particle size range is about +120 (about 124 micrometers) to about −100 (about 149 micrometers), though it is foreseeable that particles as small as about 230 mesh (about 64 micrometers) or as large as about 32 (about 420 micrometers) could be used. Using particles 16 having the preferred size range, the coating 20 of this invention will have a thickness of about 64 to about 110 micrometers, such that the particles 16 generally project from the ceramic layer 14 at least about fourteen micrometers and as much as about eighty-five micrometers.

The alloy layer 12 of this invention is preferably formed of an environmentally-resistant MCrAl alloy, and exhibits the required hot corrosion, oxidation and stress rupture properties specific to the tip 18 of the blade 10. Preferred alloys are NiCrCoAl alloys disclosed in U.S. Pat. No. 5,316,866 to Goldman et al. and U.S. patent application Ser. No. 08/290,662 to Schell et al., now abandoned, each of which are commonly assigned with the present invention and incorporated herein by reference. These alloys have the following compositional ranges, in weight percent:

| | Schell et al. | Goldman et al. |
|---|---|---|
| Chromium | 14–18 | 8–12 |
| Cobalt | 9.75–11.45 | 5–10 |
| Aluminum | 6.45–6.95 | 5–7 |
| Tantalum | 5.95–6.55 | 2–6 |
| Tungsten | — | 2–4 |
| Molybdenum | — | 1–3 |
| Rhenium | 1.85–2.35 | 0–4 |
| Titanium | — | 0–2 |
| Hafnium | 0.05–1.75 | 0–1 |
| Yttrium | — | 0–1 |
| Niobium | — | 0–1 |
| Carbon | 0.02–0.11 | 0–0.07 |
| Zirconium | 0.006–0.03 | 0–0.03 |
| Boron | 0–0.01 | 0–0.03 |
| Silicon | 0–1.1 | — |
| Balance: Nickel and typical alloying impurities | | |

The above alloys exhibit excellent oxidation and hot corrosion resistance, with the alloy disclosed by Schell et al. having a higher melting point and improved high temperature properties. Importantly, these alloys promote the ability of the alloy layer 12 to anchor the abrasive particles 16 during rub encounters with a ceramic shroud at high temperatures. Various methods can be used to form the alloy layer 12, though electroplating is preferred. Nominally, the alloy layer 12 preferably encapsulates about 30% to about 60% of each particle 16, i.e., about 30 to 60 percent of the total volume of particles 16 within the coating 20.

The ceramic layer 14 is preferably zirconia ($ZrO_2$) stabilized with yttria ($Y_2O_3$), known as YSZ, with a preferred YSZ material being zirconia stabilized with about eight volume percent yttria. It is foreseeable that other ceramic materials could be used, including zirconia stabilized by a higher or lower percentage of yttria, magnesia (MgO), ceria ($CeO_2$), (CaO), or other oxides. These particular materials can be readily deposited by plasma spraying and physical vapor deposition (PVD) techniques. The ceramic layer 14 promotes the wear resistance of the coating 20 when the blade tip 18 rubs the ceramic shroud. In addition, the ceramic layer 14 inhibits melting and softening of the underlying alloy layer 12 during a rub encounter with a hot ceramic shroud, enabling the alloy layer 12 and the underlying blade material to remain at a lower temperature.

Together, the alloy and ceramic layers 12 and 14 encapsulate an average of about 60% to about 95% of each particle 16. The remaining 5% to 40% of the particles 16 is exposed above the surface of the ceramic layer 14 to provide the desired cutting action against the shroud. Due to the deposition process for the ceramic layer 14, some degree of overcoating (capping) of the abrasive particles 16 can occur. As such, the coating 20 may be dressed to re-expose the particles 16 prior to turbine installation. Alternatively, a green run of the engine may be performed to remove any capping layer of ceramic prior to placing the engine in service.

Preferred materials for the abrasive particles 14 are microcrystalline oxides, which are effective cutting materials due to their strength and toughness and their tendency to microfracture at the cutting edge of the particle. These properties render the particles 14 particularly effective when incorporated into the alloy and ceramic layers 12 and 14 to abrade a ceramic shroud. Sol-gel alumina is a particularly preferred microcrystalline oxide, though it is foreseeable that other microcrystalline oxide materials could be used.

Preferably, the abrasive blade tip coating 20 of this invention is formed by depositing an initial layer of the NiCrCoAl alloy, generally on the order of about 10 to 500 micrometers in thickness. At this point, the abrasive particles 16 are preferably incorporated into the alloy layer 12 until a single layer of particles 16 is deposited as shown in FIG. 1, with an average of about 30% to 60% of each particle 16 being embedded in the alloy layer 12. A preferred technique for achieving this result is to electrodeposit the NiCrCoAl alloy, such as by use of the electroplating method disclosed in U.S. Pat. No. 4,789,441 to Foster et al., assigned to the assignee of this invention and incorporated herein by reference. Thereafter, the ceramic layer 14 can be deposited by known plasma spraying or PVD techniques until about 60% to about 95% encapsulation of the particles 16 is achieved. As noted above, the coating 20 may then be dressed to re-expose any particles 16 capped during deposition of the ceramic layer 14. In accordance with this invention, a near-net shape blade tip 18 can be produced by the controlled deposition processes used to form the coating 20.

While our invention has been described in terms of a preferred embodiment, it is apparent that other forms could be adopted by one skilled in the art. Therefore, the scope of our invention is to be limited only by the following claims.

What is claimed is:

1. An abrasive coating on a substrate, the abrasive coating comprising;

an MCrAl alloy layer on the substrate;

a ceramic layer of yttria-stabilized zirconia overlying the alloy layer so as to form an outer surface of the abrasive coating, and abrasive particles dispersed between the alloy layer and the ceramic layer so that at least some of the abrasive particles are partially embedded in the alloy layer and partially embedded in the ceramic layer, at least some of the abrasive particles projecting beyond the outer surface of the abrasive coating formed by the ceramic layer.

2. The abrasive coating of claim 1, wherein the alloy layer consists essentially of, in weight percent, about 8 to about 12 percent chromium, about 5 to about 10 percent cobalt, about 5 to about 7 percent aluminum, about 2 to about 6 percent tantalum, about 2 to about 4 percent tungsten, about 1 to about 3 percent molybdenum, up to about 4 percent rhenium, up to about 2 percent titanium, up to about 1 percent hafnium, up to about 1 percent yttrium, up to about 1 percent niobium, up to about 0.07 percent carbon, up to about 0.03 percent zirconium, up to about 0.03 percent boron, with the balance being nickel and incidental impurities.

3. The abrasive coating of claim 1, wherein the alloy layer consists essentially of, in weight percent, about 14 to about 18 percent chromium, about 9.75 to about 11.45 percent cobalt, about 6.45 to about 6.95 percent aluminum, about 5.95 to about 6.55 percent tantalum, about 1.85 to about 2.35 percent rhenium, about 0.5 to about 1.75 percent hafnium, about 0.02 to about 0.11 percent carbon, about 0.006 to about 0.03 percent zirconium, up to about 1.1 percent silicon, up to about 0.01 percent boron, with the balance being nickel and incidental impurities.

4. The abrasive coating of claim 1, wherein abrasive particles are microcrystalline oxide particles.

5. The abrasive coating of claim 1, wherein the abrasive particles are sol-gel alumina particles.

6. The abrasive coating of claim 1, wherein an average of about 30 to about 60 volume percent of the abrasive particles is embedded in the alloy layer.

7. The abrasive coating of claim 6, wherein an average of about 60 to about 95 volume percent of the abrasive particles is embedded within the alloy and ceramic layers.

8. The abrasive coating of claim 1, wherein an average of about 60 to about 95 volume percent of the abrasive particles is embedded within the alloy and ceramic layers.

9. The abrasive coating of claim 1, wherein the substrate is a nickel superalloy turbine blade tip.

10. An abrasive coating on a nickel superalloy substrate, the abrasive coating comprising;

an alloy layer on the substrate, the alloy layer consisting essentially of, in weight percent, about 14 to about 18 percent chromium, about 9.75 to about 11.45 percent cobalt, about 6.45 to about 6.95 percent aluminum, about 5.95 to about 6.55 percent tantalum, about 1.85 to about 2.35 percent rhenium, about 0.5 to about 1.75 percent hafnium, about 0.02 to about 0.11 percent carbon, about 0.006 to about 0.03 percent zirconium, up to about 1.1 percent silicon, up to about 0.01 percent boron, with the balance being nickel and incidental impurities;

a ceramic layer overlying the alloy layer so as to form an outer surface of the abrasive coating, the ceramic layer being yttria-stabilized zirconia; and a single layer of microcrystalline oxide particles dispersed between the alloy layer and the ceramic layer so that about 30 to 60 volume percent of the particles is embedded in the alloy layer and so that about 60 to about 95 volume percent of the particles is embedded within the alloy and ceramic layers, such that at least some of the particles project above the outer surface of the abrasive coating formed by the ceramic layer.

11. The abrasive coating of claim 10, wherein the nickel superalloy substrate is a blade tip of a turbine blade.

12. A method for forming an abrasive coating on a substrate, the method comprising the steps of;

depositing an MCrAl alloy on the substrate;

incorporating a dispersion of abrasive particles into the MCrAl alloy after an initial layer of the MCrAl alloy is formed, such that continued deposition of the MCrAl alloy causes the abrasive particles to be partially embedded therein; and depositing a ceramic layer of yttria-stabilized zirconia on the MCrAl alloy so as to form an outer surface of the abrasive coating, the abrasive particles being partially embedded in the ceramic layer such that at least some of the abrasive particles project above the outer surface of the abrasive coating formed by the ceramic layer.

13. The method of claim 12, wherein the alloy layer consists essentially of, in weight percent, about 8 to about 12 percent chromium, about 5 to about 10 percent cobalt, about 5 to about 7 percent aluminum, about 2 to about 6 percent tantalum, about 2 to about 4 percent tungsten, about 1 to about 3 percent molybdenum, up to about 4 percent rhenium, up to about 2 percent titanium, up to about 1 percent hafnium, up to about 1 percent yttrium, up to about 1 percent niobium, up to about 0.07 percent carbon, up to about 0.03 percent zirconium, up to about 0.03 percent boron, with the balance being nickel and incidental impurities.

14. The method of claim 12, wherein the alloy layer consists essentially of, in weight percent, about 14 to about 18 percent chromium, about 9.75 to about 11.45 percent cobalt, about 6.45 to about 6.95 percent aluminum, about 5.95 to about 6.55 percent tantalum, about 1.85 to about 2.35 percent rhenium, about 0.5 to about 1.75 percent hafnium, about 0.02 to about 0.11 percent carbon, about 0.006 to about 0.03 percent zirconium, up to about 1.1 percent silicon, up to about 0.01 percent boron, with the balance being nickel and incidental impurities.

15. The method of claim 12, wherein the ceramic layer is deposited by a plasma spray or PVD technique.

16. The method of claim 13, wherein the abrasive particles are sol-gel alumina particles.

17. The method of claim 12, wherein an average of about 30 to about 60 volume percent of the abrasive particles is embedded in the alloy layer, and wherein an average of about 60 to about 95 volume percent of the abrasive particles is embedded within the alloy and ceramic layers.

18. The method of claim 12, wherein the MCrAl alloy is deposited by electroplating.

19. The method of claim 12, wherein the substrate is a nickel superalloy turbine blade tip.

* * * * *